United States Patent [19]

Sanagi

[11] Patent Number: 4,718,225

[45] Date of Patent: Jan. 12, 1988

[54] PNEUMATIC SPINNING MACHINE

[75] Inventor: Asao Sanagi, Kyoto, Japan

[73] Assignee: Murata Kaiki Kabushiki Kaisha, Kyoto, Japan

[21] Appl. No.: 879,334

[22] Filed: Jun. 27, 1986

[30] Foreign Application Priority Data

Jun. 27, 1985 [JP] Japan ..... 60-141383

[51] Int. Cl.[4] ..... D01H 5/28; D01H 5/26; D01H 5/74

[52] U.S. Cl. ..... 57/328; 19/244; 57/5; 57/350

[58] Field of Search ..... 57/5, 6, 12, 315, 328, 57/350, 333; 19/244, 245, 249–251, 258, 259, 262–265

[56] References Cited

U.S. PATENT DOCUMENTS

| | | | |
|---|---|---|---|
| 2,853,847 | 9/1958 | Keeler et al. | 57/328 |
| 2,925,628 | 2/1960 | Boer | 19/258 |
| 2,990,673 | 7/1961 | Adkins, Jr. | 57/12 |
| 3,487,619 | 1/1970 | Field, Jr. | 57/328 |
| 4,351,146 | 9/1982 | Faure et al. | 57/328 X |
| 4,387,487 | 6/1983 | Nakahara et al. | 19/249 |
| 4,434,611 | 3/1984 | Hasegawa et al. | 57/328 |
| 4,450,675 | 5/1984 | Petrov et al. | 57/328 X |
| 4,565,063 | 1/1986 | Stalder et al. | 57/328 |

FOREIGN PATENT DOCUMENTS 60-7048 2/1985 Japan .

*Primary Examiner*—John Petrakes

*Attorney, Agent, or Firm*—Barnes, Kisselle, Raisch, Choate, Whittemore & Hulbert

[57] ABSTRACT

An improved pneumatic spinning machine of the type which includes a draft device composed of a plurality of pairs of rollers, and an air injecting nozzle for producing whirling flows of air to act upon a bundle of fibers fed from the draft device. A front roller of the draft device has an annular air escaping groove formed on a circumference thereof.

8 Claims, 6 Drawing Figures

PNEUMATIC SPINNING MACHINE

FIELD OF THE INVENTION AND RELATED ART STATEMENT

This invention relates to a pneumatic spinning machine, and more particularly to an improvement to a pneumatic spinning machine of the type which includes a draft device composed of a plurality of pairs of rollers, and an air injecting nozzle for producing whirling flows of air to act upon a bundle of fibers fed from the draft device.

The fundamental structure of a pneumatic spinning machine of the type described above and its spinning principle are disclosed, for example, in Japanese publication patent No. Sho 60-7048. According to the patent, a bundle of fibers such as a sliver is introduced into and drafted by a draft device including back rollers, middle rollers and front rollers, and is then introduced into an air injecting nozzle while it remains in an open condition. The air injecting nozzle has first and second nozzles disposed along an advancing direction of a bundle of fibers for producing flows of air whirling in opposite directions to act upon a bundle of fibers. The second nozzle provides a temporary twist to a bundle of fibers while the first nozzle balloons the thus temporarily twisted bundle of fibers in a direction opposite to the direction of the temporary twist. Part of fibers of the fiber bundle fed from the front rollers are separated and detached by such ballooning and wound around the remaining fibers and are then twined further firmly around the latter after passing the second nozzle, thereby producing a spinning yarn. In such spinning steps as described above, it is important that individual fibers constituting a fiber bundle pass the draft device while they maintain sufficient parallellism and that a bundle of fibers after passing the front rollers draws stabilized ballooning. If the parallellism of fibers is disturbed, irregular drafting will be resulted, which will lead to irregularities in thickness in a yarn produced, resulting in deterioration in strength of the yarn. Further, if there appears a disturbance in ballooning, the yarn will not be twisted or united sufficiently, resulting in deterioration in strength of the yarn.

A pneumatic spinning machine has a high speed spinning capacity of 100 to 300 meter/minute or more, and the circumferential speed of the front rollers reaches a value very near to the spinning speed of the machine. Accordingly, as the front rollers rotate at such a high speed, accompanying flows of air will appear around the rollers. But since such accompanying air flows act in a converging direction at an entrance portion of the nip point of the front rollers, turbulent flows will appear at this portion and will disturb an arrangement of fibers of the fiber bundle and act to scatter the fibers. While attempts have been made to modify front rollers into various shapes or structures in order to remove such accompanying air flows as described above, depending upon some shapes of rollers or the like, accompanying air flows at an exit portion of the nip point may sometimes disturb ballooning of a fiber bundle and thus have bad influences upon separating and turning actions of the fibers.

OBJECT AND SUMMARY OF THE INVENTION

It is an object of the present invention to provide an improved pneumatic spinning machine which resolves such problems as described above, and more particularly to provide a pneumatic spinning machine which can eliminate bad influences of such accompanying flows of air as described above to produce yarns of a good quality.

According to the present invention, a pneumatic spinning machine of the type which includes a draft device composed of a plurality of pairs of rollers such as beck rollers, middle rollers and front rollers, and an air injecting nozzle for producing whirling flows of air to act upon a bundle of fibers fed from the draft device, whereby a bundle of fibers fed from a front roller of the draft device is acted upon and ballooned by whirling flows of air in order to twist the bundle of fibers, characterized in that the front roller has annular air escaping grooves formed on a circumference thereof and located at such a position spaced outwardly by a predetermined distance from the width of the bundle of fibers at a nip point of the front roller that air flows passing through the air escaping groove may not disturb ballooning of the bundle of fibers.

Accompanying flows of air produced at the entrance portion of the nip point of the front roller pass through the air escaping groove formed on the circumferential face of the front roller and flow to the exit portion of the nip point. Accordingly, production of turbulent flows at the entrance portion can be prevented, and hence disturbances of fibers can be prevented. Further, since the air escaping groove is spaced by the predetermined distance from a bundle of fibers at the nip point of the front roller, air flows passing through the groove are discharged sidewardly of the fiber bundle which is being ballooned at the entrance of the nip point, and hence ballooning of the fiber bundle will not be disturbed.

DETAILED DESCRIPTION OF PREFERRED EMBODIMENTS

Figure 3:
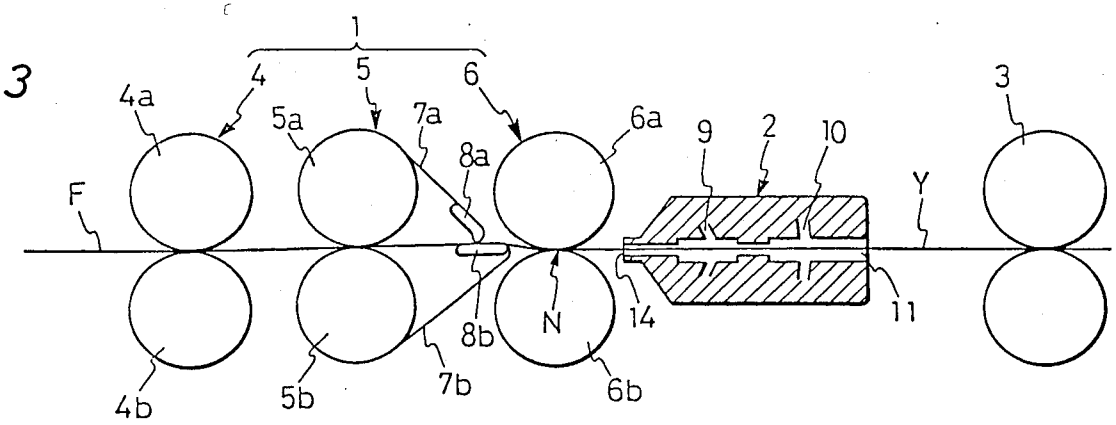
FIG. 3 is a side elevational view showing a general construction of a spinning frame according to the present invention, FIG. 4 a view illustrating an example where an air escaping groove is located improperly.

FIG. 3 shows a general construction of a pneumatic spinning machine according to the present invention. An untwisted sliver, that is, an untwisted bundle F of fibers, extracted from a sliver (not shown) after being drawn from a drawing frame, is introduced into a draft device 1 and then supplied to an air injecting nozzle 2 so as to be formed into a spinning yarn Y which is fed out by a pair of delivery rollers 3 and then wound up by a winder not shown. The draft device 1 is composed of a series of rollers including a pair of back rollers 4, another pair of middle rollers 5 and a further pairs of front rollers 6 with their top rollers **4*a*, 5*a* and 6*a* and bottom rollers 4*b*, 5*b* and 6*b* contacted with each other, respectively, under a predetermined pressure exerted by respective springs not shown. The bottom rollers 4*b*, 5*b* and 6*b* are rotated in a direction to feed the fiber bundle F in a rightward direction while the top rollers 4*a*, 5*a*** and 6*a* are rotated by rotation of the bottom rollers 4*b*, 5*b* and 6*b*, respectively. The circumferential speed is lowest at the back rollers 4 and highest at the front rollers 6 so as to draft the fiber bundle F due to such differences in circumferential speed. A pair of aprons 7*a* and 7*b* each composed of an endless rubber belt extend around the middle rollers 5 under a predetermined tension provided by a pair of tension servers 8*a* and 8*b*, respectively. The air injecting nozzle 2 has first and second air injecting nozzles 9 and 10 formed to extend along a path for the fiber bundle F therein. The first and second air injecting nozzles 9 and 10 produce compressed air flows which are whirled to turn the fiber bundle F in opposite directions and urge it toward a nozzle entrance 11. The whirling force of the second nozzle 10 is greater than that of the first nozzle 9 and the second nozzle 10 thus provides a temporary twist to the fiber bundle F. Such a temporary twist propagates from the second nozzle 10, to a front roller nip point N over the fiber bundle F while the first nozzle 9 balloons the fiber bundle F having such a temporary twist in a direction opposite to the direction of the temporary twist.

Figure 1:
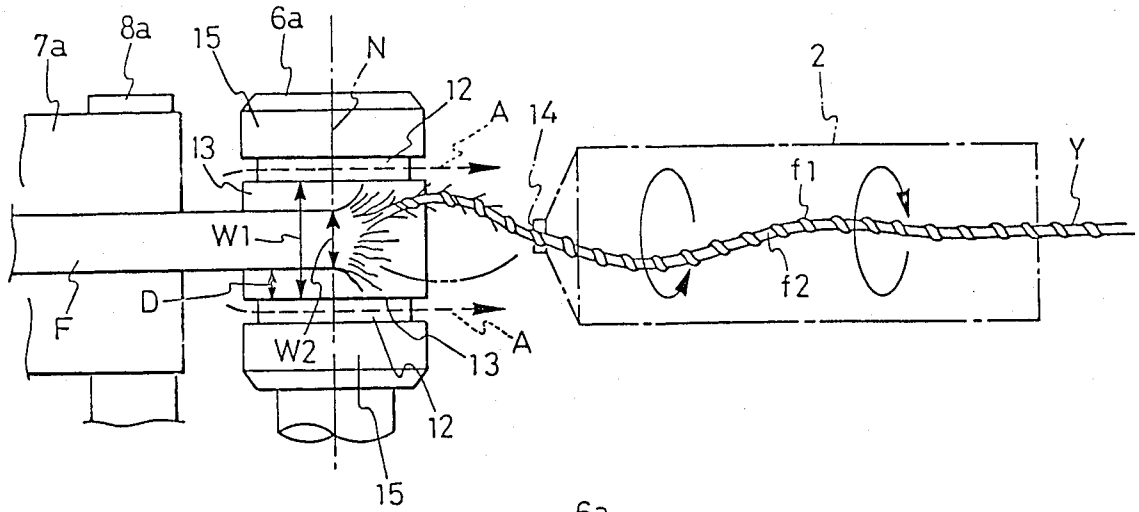
FIGS. 1 and 2 illustrate essential part of a spinning frame according to the present invention, and FIG. 1 being a view of a front top roller as viewed from below and FIG. 2 being a side elevational view.

FIG. 1 illustrates the front rollers being essential part of a first embodiment of the present invention and some elements around the front rollers. The front top roller 6*a* of the front rollers 6 has two annular air escaping grooves 12 formed thereon with the distance W1 between inner walls 13 of the grooves 12 selected to be greater than the width W2 of the fiber bundle F at the nip point N of the front rollers 6. The fiber bundle F will be ballooned greatly between the nip point N thereof and a nozzle entrance 14 as seen in FIG. 1 but is in a flattened shape at the nip point N. Accordingly, fibers adjacent opposite sides of the fiber bundle F are acted upon by a higher tensile force than fibers at the center of the fiber bundle F and hence may be easily broken or separated by such ballooning. Such separated and detached fibers f1 are twined in the same direction with such ballooning around the other fibers f2 having the temporary twist, and then as they pass the second nozzle 10, the fiber bundle F undergoes an action to untwist the temporary twist thereof so that the fibers f2 making a core of the fiber bundle F is untwisted while the twined fibers f1 is wound more firmly around the fibers f2 thereby to produce a spinning yarn Y. Due to the fact that the fiber bundle F is released from a nipping force of the front rollers 6 at the exit of the nip point and that fibers are separated by ballooning as described above, a large number of fibers in the form of fluff will be produced as seen in FIG. 1 and make such wound fibers f1 as described above. Accordingly, as fluff fibers appear more widely at opposite side of the fiber bundle F and more in quantity, a spinning yarn Y produced will have a greater uniting force. Meanwhile, since such fluff fibers are twined by ballooning, if such ballooning is not stable, sufficient twining of fibers will not be achieved and as a result a yarn Y produced will have a weak uniting force and much irregularity.

When the front rollers 6 rotate at a high speed, accompanying flows of air which flows in a direction to converge to the nip point N will appear at the entrance portion of the nip point N of the rollers 6, that is, at a portion via which the fiber bundle F advances to the nip point N. Most of such accompanying air flows will pass through the air escaping grooves 12 and flow out to the exit of the nip point N as shown by arrow marks A in broken lines. Accordingly, at the entrance of the nip point N, appearance of turbulent flows by such accompanying air flows A will be controlled, and hence disturbance of an arrangement of fibers of the fiber bundle F and scattering of fibers at the entrance of the nip point N can be prevented. Further, since the air escaping grooves 12 are formed in a spaced relationship by a predetermined distance D from the fiber bundle F at the front roller nip point N, air flows A passing through the grooves 12 will flow sidewardly of the fiber bundle F being ballooned and hence have no bad influence on production of fibers in the form of fluff nor on a ballooning behavior of the fiber bundle F.

Figure 4:
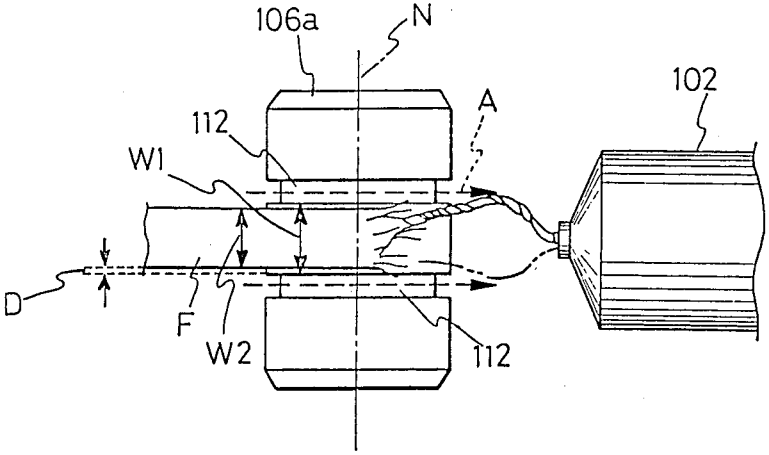

FIG. 4 is a view showing an undesirable embodiment and it illustrates a modified front top roller wherein the distance W1 between the grooves 112 is substantially equal to the width W2 of a fiber bundle F at the front roller nip point N to substantially eliminate the distance D between the fiber bundle F and the grooves 112. 102 designates an air injecting nozzle. In this instance, problems caused by appearance of turbulent air flows at the entrance of the nip point can be eliminated, but air flows passing through the grooves 112 will act upon the ballooning fiber bundle F and disturb the ballooning movement of the fiber bundle F while appearance of fibers in the form of fluff at the exit of the nip point will be controlled by an action of the air flows. Accordingly, in this case, a yarn Y produced may readily have a weak uniting force and much irregularity relative to a yarn produced by the apparatus as shown in FIG. 1.

Figure 2:
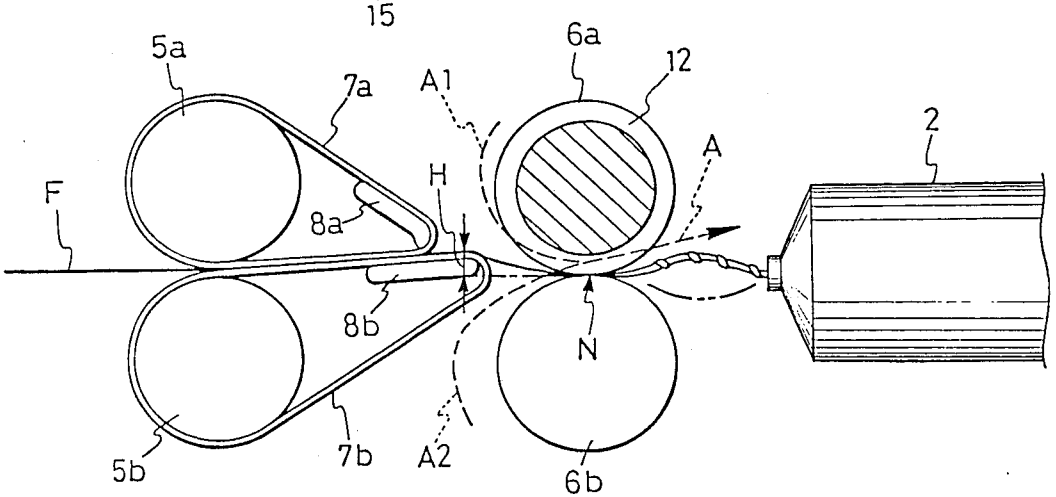

FIG. 2 shows a side elevational view of the front rollers of the first embodiment of the present invention and some elements around the front rollers. The air escaping grooves 12 are formed only on the front top roller 6*a* made of a rubber material, and the front bottom roller 6*b* made of a metal material has no such air escaping groove formed thereon. Meanwhile, an end of the apron 7*b* of the middle bottom roller 5*b* extends nearer to the front roller nip point N than an end of the apron 7*a* of the middle top roller 5*a*. This is because disposition of the end of the apron 7*b* very near to the nip point N will prevent production of floating fibers between the apron 7*b* and the nip point N. Further, the end of the apron 7*b* is displaced a predetermined distance H above the nip point N. Accompanying air flows A produced by rotation of the front rollers 6 at a high speed will flow as seen in FIG. 2. Accompanying air flows A1 around the front top roller 6*a* will flow smoothly through the air escaping grooves 12 while accompanying air flows A2 around the front bottom roller 6*b* will flow into the grooves 12 under the guidance of a lower face of the lower apron 7*b*. Thus, composite air flows of the accompanying air flows A1 and A2 flowing out from the exit of the nip point will flow a little above the fiber bundle F being ballooned.

Figure 5:
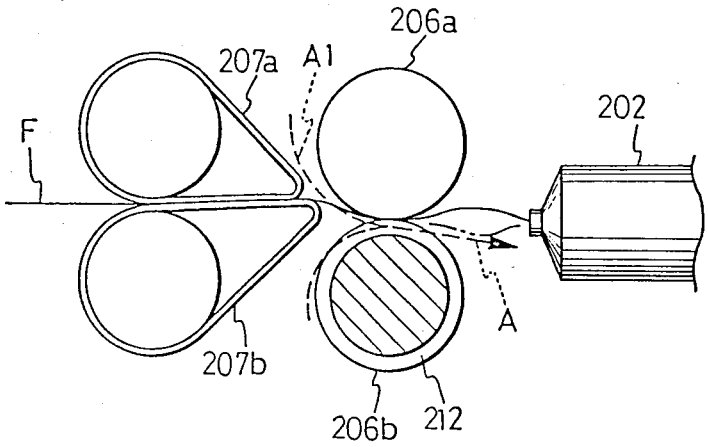
FIGS. 5 and 6 are side elevational views illustrating different embodiments according to the invention.

FIG. 5 illustrates a second embodiment of the invention in which the air escaping grooves 212 are formed only on the front bottom roller 206*b* while the aprons 207*a* and 207*b* are disposed in the same configuration as that in FIG. 2. In this instance, air flows flowing out from the exit of the nip point will flow below the fiber bundle F being ballooned. Accordingly, bad influences on ballooning of the fiber bundle F can be reduced in a similar manner as in the arrangement of FIG. 2, but since accompanying air flows A1 around the front top roller 206*a* will flow near the ends of the aprons 207*a* and 207*b*, the modified arrangement is disadvantageous in that an arrangement of fibers may readily be disturbed comparing with that of FIG. 2.

Figure 6:
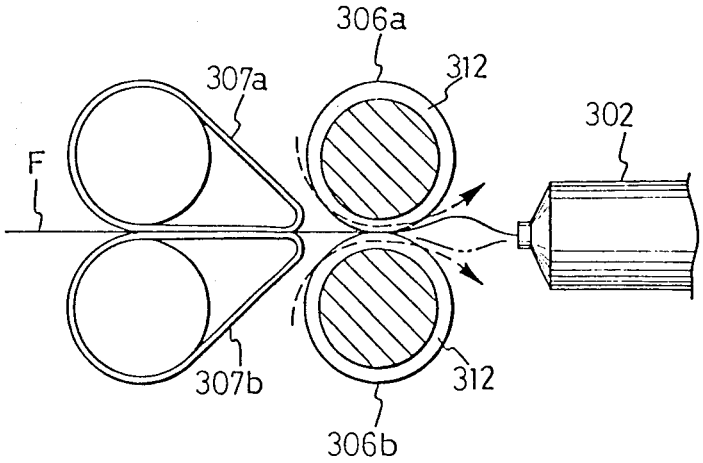

FIG. 6 illustrates another embodiment of the invention in which the air escaping grooves 312 are formed on both of the front top roller 306*a* and the front bottom roller 306*b* and the ends of the aprons 307*a* and 307*b* are located at the same height as the front roller nip point N. In this instance, accompanying air flows produced will flow as seen in FIG. 6 and hence have little influence on ballooning of the fiber bundle F comparing with the arrangements of FIGS. 2 and 5.

From the studies as above, it can be understood that the most preferable results can be attained by the arrangement wherein the ends of the aprons 7 of the middle rollers 5 are displaced in a vertical direction and the air escaping grooves 12 are formed on a circumferential face of one of the front rollers toward which the ends of the aprons 7 are displaced, that is, by the arrangement as shown in FIG. 2. Such displacement of the ends of the aprons will result in reduction of an influence on the fiber bundle F of accompanying air flows at the entrance of the nip point of the front rollers. Also where the air escaping grooves 12 are formed in one of the front rollers which is remote from the displaced ends of the aprons, that is, in the arrangement as shown in FIG. 5, some effects can be recognized, but lowest effects can be provided by the arrangement wherein the air escaping grooves 312 are formed on both of the front rollers 306*a* and 306*b* as seen in FIG. 6.

The locations of the air escaping grooves 12 must be such that they are displaced by a predetermined distance from the fiber bundle F at the front roller nip point N so that air flows A passing through the grooves 12 may not disturb ballooning of the fiber bundle F, and concretely the distance D is preferably 2 to 6 mm or so. Since the fiber bundle F at the nip point N has some fluff therearound, if the distance D is reduced less than 1 mm, the distance may be substantially ignored as it does not exist, and in this instance, air flows A passing through the air escaping grooves 12 will have a bad influence on ballooning of the fiber bundle F. On the contrary, if the distance D is increased to 7 mm or more, appearance of turbulent air flows around the fiber bundle F at the entrance of the nip point cannot be prevented sufficiently.

The width and depth of the air escaping grooves 12 depend upon the circumferential speed of the front rollers 6 and so on, and generally speaking, the width is preferably 2 to 3 mm or so and the depth is preferably 1.5 to 2 mm or so.

It is to be mentioned that the shape of the air escaping grooves 12 is not limited particularly and may be designed to have any of various suitable cross sectional shapes. Further, while it is also possible to remove, referring to FIG. 1, portions 15 of the front top roller 6*a* on opposite outer sides of the air escaping grooves 12 so as to change the grooves 12 into shoulders or else to remove the grooves 12 outside the inner walls 13 thereof together with such roller portions 15 as described above in order to make the length of the front top roller 6*a* along an axis thereof coincide with the width W1 described above, such modifications are not preferable because slipping may readily appear between the front rollers 6*a* and 6*b* and it is difficult to maintain the nipping pressure to the fiber bundle F between the rollers 6*a* and 6*b* to a suitable level. Further in the present embodiment the second nozzle 10 of the air injecting nozzle 2 may be replaced by any other temporary twisting device such as, for example, a belt type temporary twisting device wherein a pair of endless belts are circulated along paths intersecting with each other in an X-shape and a yarn is nipped between the belts in order to provide a temporary twist to the yarn.

According to the present invention, a bad influence to be had on a bundle of fibers by accompanying flows of air appearing around front rollers can be eliminated, and hence spinning yarns of a high quality can be produced.

What is claimed is:

1. A pneumatic spinning machine of the type which includes a draft device composed of a series of rollers comprising a pair of back rollers, another pair of top and bottom middle rollers and a further pair of top and bottom front rollers, and an air injecting nozzle for producing whirling flows of air to act upon a bundle of fibers fed from said draft device, whereby a bundle of fibers fed from said front rollers of said draft device is acted upon and ballooned by whirling flows of air in order to twist the bundle of fibers, characterized in that said front rollers have smooth opposed uninterrupted nip sufaces for moving a bunch of fibers into said air injecting nozzle, and one or more of said front rollers has a pair of circumferential air escape grooves in the surfaces thereof spaced to each side of said smooth nip surfaces wherein each air escape groove is located at such a position spaced outwardly by a predetermined distance from the width of the bundle of fibers at said nip surface of said front rollers that air passing through said air escape groove will not disturb ballooning of the bundle of fibers.

2. A pneumatic spinning machine as claimed in claim 1 wherein each said air escape groove is formed on a circumference of a front top roller.

3. A pneumatic spinning machine as claimed in claim 1 wherein each said air escape groove is formed on a circumference of a front bottom roller of the draft device.

4. A pneumatic spinning machine as claimed in claim 3 wherein a pair of aprons each composed of an endless rubber belt extend around a middle top roller and a middle bottom roller under a predetermined tension provided by a pair of tension servers, respectively, and an end of the apron of the middle bottom roller extends nearer to the nip point of the front roller than an end of the apron of the middle top roller, said end of the apron of the middle bottom roller being displaced a predetermined distance above a line connecting the nip point of the front rollers with the containing point of the middle top roller and the middle bottom roller so that accompanying air flow around the front top roller and the front bottom roller flows into an escaping groove and flows out from an exit of the nip point in the direction a little below the fiber bundle.

5. A pneumatic spinning machine as claimed in claim 1 wherein each said air groove is formed in the circumference of a front top roller and a front bottom roller of the draft device respectively.

6. A spinning machine as claimed in claim 1 wherein a location of the air escape groove is displaced by 2 to 6 mm from the both sides of the fiber bundle at a nip point of the front rollers.

7. A pneumatic spinning machine as claimed in claim 6 wherein a width of the air escape groove is 2 to 3 mm and a depth of the air escaping groove is 1.5 to 2 mm.

8. A pneumatic spinning machine as claimed in claim 1 wherein a pair of aprons each composed of an endless rubber belt extend around a middle top roller and a middle bottom roller under a predetermined tension provided by a pair of tension servers, respectively, and an end of the apron of the middle bottom roller extends nearer to the nip point of the front roller than an end of the apron of the middle top roller, said end of the apron of the middle bottom roller being displaced a predetermined distance above a line connecting the nip point of the front rollers with the containing point of the middle top roller and the middle bottom roller so that accompanying air flow around the front top roller and the front bottom roller flows into an escaping groove and flows out from an exit of the nip point in the direction a little above the fiber bundle.

* * * * *